United States Patent [19]

Saito et al.

[11] Patent Number: 4,948,381

[45] Date of Patent: Aug. 14, 1990

[54] INSULATION-PIERCING CONNECTOR

[75] Inventors: Yukio Saito; Akio Yamada, both of Utsunomiya, Japan

[73] Assignee: Daiichi Denshi Kogyo Kabushiki Kaisha, Japan

[21] Appl. No.: 287,383

[22] Filed: Dec. 20, 1988

[30] Foreign Application Priority Data

Dec. 25, 1987 [JP] Japan ..... 62-197170
Oct. 7, 1988 [JP] Japan ..... 63-253419

[51] Int. Cl.[5] ..... H01R 4/24
[52] U.S. Cl. ..... 439/405; 439/407
[58] Field of Search ..... 439/404, 405, 407, 417–419, 439/395, 397, 456, 459, 465, 467

[56] References Cited

U.S. PATENT DOCUMENTS

| | | | |
|---|---|---|---|
| 4,009,922 | 3/1977 | Aysta | 339/99 R |
| 4,026,625 | 5/1977 | Roiko et al. | 439/405 |
| 4,444,450 | 4/1984 | Huber | 439/465 |
| 4,641,903 | 2/1987 | Anhalt et al. | 439/404 |
| 4,693,539 | 9/1987 | Tighe, Jr. | 439/465 |

FOREIGN PATENT DOCUMENTS

| | | | |
|---|---|---|---|
| 2312171 | 12/1976 | France | 439/465 |

*Primary Examiner*—David L. Pirlot

*Attorney, Agent, or Firm*—Silverman, Cass & Singer, Ltd.

[57] ABSTRACT

An insulation-piercing connector includes a connector body made of an insulating material, and a plurality of contacts made of a resilient conductive metal. Each of the contacts consists of a contact element to be connected to a contact of a mating connector, a fixing element carried by the connector body and a U-shaped piercing terminal element extending from a surface of the connector body and embracing a wire between legs of the U-shaped element. The contacts are arranged staggered in at least two rows. A cover is maade of an insulating material and formed with terminal element receiving grooves for receiving the U-shaped elements of the contacts. When the cover is covered onto the connector body, the cover forces wire into the U-shaped elements and embraces the wires between the cover and the connector body. Surfaces of the connector body for embracing the wires in conjunction with the cover are raising inclination surfaces from a side of the U-shaped piercing elements in one row toward above the U-shaped piercing elements in the othe row to form alternately reversely inclined surfaces, and surfaces of the cover for embracing the wires are inclination surfaces auxiliary with said alternately inclined surfaces of the connector body.

8 Claims, 10 Drawing Sheets

INSULATION-PIERCING CONNECTOR

BACKGROUND OF THE INVENTION

This invention relates to an insulation-piercing connector capable of connecting wires in high density.

Owing to the development of integrated circuit elements and other semiconductor parts, miniaturization of various kinds of electronic appliances has progressed. With such a progression, requirements have been also raised for miniaturization of connectors for use in connection between the electronic appliances.

Therefore, with insulation-piercing connectors, the following modifications have been effected. As shown in FIG. 1*a*, in an insulating support block 1 of a connector body A are embedded a plurality of contacts, each formed with a pressing slit 2*a* at a center of its tail 2, and oblique blades 2*b* on both sides thereof. A plurality of connection wires 3 are pressed into the pressing slits 2*a* of the tails of contacts by a cover B, so that the blades 2*b* of each of the contacts 2*b* are caused to penetrate into a coating 3*a* of the wire 3 so as to arrive into a core 3*b* of the wire 3. Thereafter, the connection wires 3 are further pressed into the pressing slits 2*a* of the tails 2 of the contacts, thereby connecting the wire 3 to the contacts of the connector.

As shown in FIG. 2*a*, the contact tails 2 are arranged in two rows and the contact tails 2 of each of the rows are arranged with minimum distances so that the connection wires 3 are able to be inserted into the pressing slits 2*a* without difficulty. Moreover, the pressing slit 2*a* of each contact tail 2B in the second row is arranged at a center between the pressing slits 2*a* of adjacent two contact tails 2A in the first row so that the contact tails 2A and 2B are arranged in a so-called "staggered arrangement" as shown in FIGS. 2*a* and 2*b*. It has been actually effected to make the length of the support block 1 as short as possible by making diameters D of the connection wires 3 and widths R of the contact tails 2 as small as possible.

However, there is a limitation for the reduction in diameter of wires and width of contact tails because of problems caused from electric current to be supplied and mechanical strength of the contact tails. For example, the contact tail is required to have mechanical strength to a certain extent for preventing any faulty connection of wires resulting from deformations of the oblique blades 2*b* in pressing the wires into the pressing slits 2*a* of the contact tails. It is actually difficult to make the diameter D of wires less than 0.3 mm and the width W of the contact tails less than 0.75 mm. Therefore, any particular idea is required for accomplishing further miniaturization of connectors.

SUMMARY OF THE INVENTION

It is a primary object of the invention to provide an improved small type connector which is more miniaturized in comparison with existing miniaturized connectors.

The subject matters of this invention lies in the following features. With a connector having contacts arranged staggered in two rows, a connection wire 3A to be connected to a contact tail 2A in a first row and a connection wire 3B to be connected to a contact tail 2B in a second row are arranged in directions reverse relative to each other downwardly toward contact tails to connected, respectively, as shown in FIG. 3*a*. Moreover, the connector body and the cover are provided with connection wire holding inclined surfaces whose inclinations are so determined that the connection wire 3B to be connected to the contact tail 2B in the second row is arranged above the uppermost end of the contact tail 2A in the first row and the connection wire 3A to be connected to the contact tail 2A in first row is arrange above the uppermost end of the contact tail 2B in the second row.

With this arrangement, connection wires 3A and 3B can be connected to contact tails without passing between contact tails 2B and 2A in the other row, thereby reducing distances 1 between the contact tails to a minimum possible distance without detrimentally affecting the insulation between wires as shown in FIGS. 3*b* and 3*c*. In this manner, a further miniaturization of connector is accomplished.

The invention will be more fully understood by referring to the following detailed specification and claims taken in connection with the appended drawings.

DESCRIPTION OF THE PREFERRED EMBODIMENT

Figure 4A:
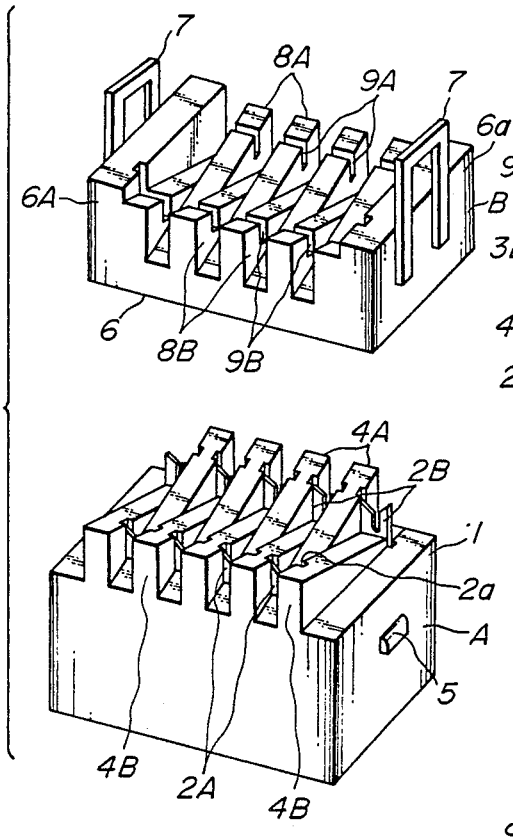
FIGS. 4*a*, 4*b* and 4*c* are views illustrating a first embodiment of the connector according to the invention.
Figure 4B:
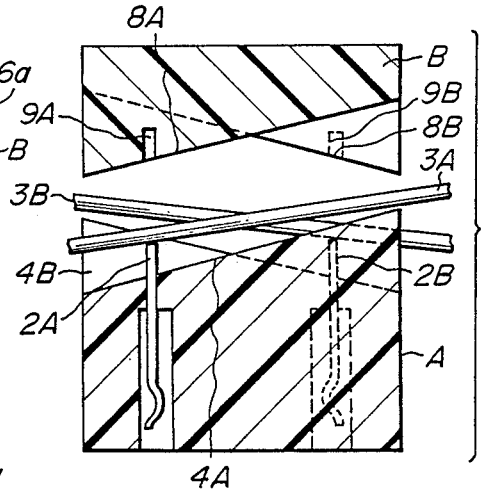

FIGS. 4*a* and 4*b* illustrating one embodiment of the invention are a perspective view of a non-pierced condition and a sectional side view of pierced condition. FIG. 4*a* illustrates a connector body A made of an insulating contact support block 1, contact tails 2A and 2B in first and second rows, and first and second support bases 4A and 4B for obliquely arranging connection wires. The first and second support bases 4A and 4B are alternately arranged. The first support base 4A has an inclination directing downwardly toward the contact tails 2A in the first row, while the second support base 4B has an inclination directing downwardly toward the contact tails 2B in the second row. Moreover, the inclinations of the first and second support bases 4A and 4B are so selected that surfaces of the first and second support bases 4A and 4B corresponding to uppermost ends of the contact tails 2A and 2B in the first and second rows are located above the uppermost ends of the contact tails 2A and 2B. Reference numeral 5 denotes locking protrusions"

Figure 4C:
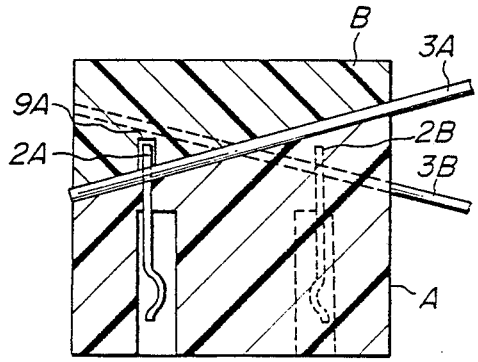

In FIG. 4*a*, a cover B comprises an insulating block 6 having positioning walls 6*a* for positioning the cover B relative to the connector body A, and U-shaped locking members 7 adapted to be engaged with the locking protrusions 5 of the connector body A. First and second push bases 8A and 8B for obliquely arranging the connection wires are alternately arranged and have inclinations which are in parallel with and reversely inclined to that of the inclinations of the connector body A so that the connection wires are embraced between the inclinations of the connector body A and the cover B when the cover B is connected to the connector body A by means of the locking protrusions 5 and the U-shaped locking members 7. The cover B is formed with contact tail receiving grooves 9A and 9B for receiving the contact tails 2A and 2B when the cover B is connected to the connector body as shown in FIG. 4*c*.

The operation of the connector above described will be explained by referring to FIGS. 4*a*, 4*b* and 4*c*.

After the connection wires 3A and 3B have been arrange on the first and second support bases 4A and 4B of the connector body A as shown in FIG. 4*b*, the cover B is arranged and locked onto the connector body A such that surfaces of the inclinations of the first and second push bases 8A and 8B of the cover B are aligned with surfaces of the inclinations of the first and second support bases 4A and 4B of the connector body B and the contact tails 2A and 2B are brought into the contact tail receiving grooves 9A and 9B. As a result, the connection wires 3A are pressed into pressing slits 2*a* of the contact tails 2A in the first row so as to be connected to the contact tails 2A, while the connection wires 3B are pressed into pressing slits 2*a* of the contact tails 2B in the second row so as to be connected to the contact tails 2B as shown in FIG. 4*c*. Moreover, the connection wires 3A are positioned above the uppermost ends of the contact tails 2B in the second row and the connection wires 3B are positioned above the uppermost ends of the contact tails 2A in the first row, while these connection wires 3A and 3B are embraced and held between the support bases 4A and 4B and push bases 8A and 8B.

Therefore, the connection wires do not extend between the contact trails, so that distances between the contact tails can be shortened to accomplish the miniaturization of the connector.

Figure 5:
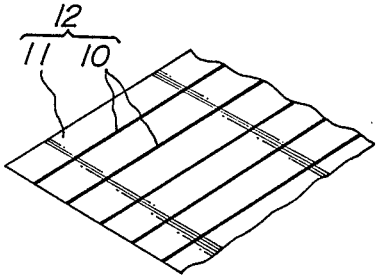
FIGS. 5 and 6 are explanatory views of a flat cable and a connector according to the invention using the flat cable.
Figure 6:
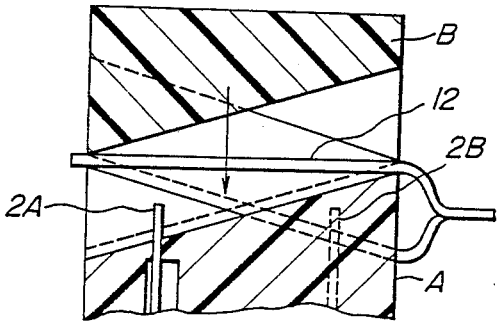

Although the embodiment of the invention has been explained with the piercing connection of the multiplicity of single wires, the connector according to the invention can be applicable to a flat cable which, for example, comprises a number of bare wires 10 arranged in parallel with predetermined intervals and coated with a resin insulating material 11 to form a flat cable 12 as shown in FIG. 5. In this case, after the flat cable 12 has been arranged on the connector body A such that the bare wires 10 of the flat cable 12 are positioned on the support bases 4*a* and 4B, the cover B is forced onto the connector body A. As a result, the coating 11 between the bare wires 10 is pierced with the contact tails 2A and 2B so that the bare wires enter bottoms between the support bases 4A and 4B to be settled onto the inclinations of the connector body A and the cover B, whereby connection of the flat cable is established.

Figure 7:
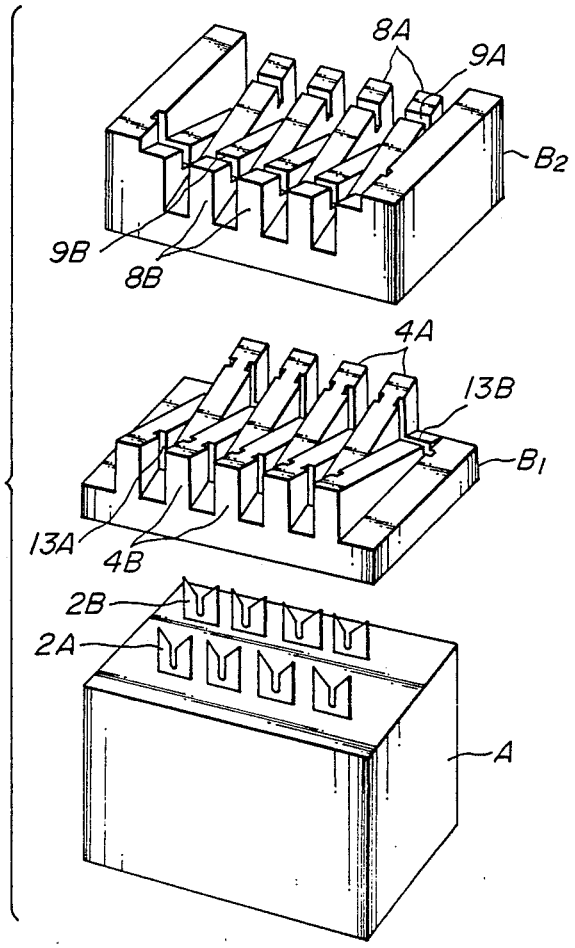
FIGS. 7, 8*a*, 8*b*, 9*a*, 9*b*, 10*a*, 10*b* and 10*c* are views illustrating other embodiments of the connectors according to the invention.

Another embodiment of the invention shown in FIG. 7 is quite different from the embodiment above described. In FIG. 7, a cover B is divided into two parts $B_1$ and $B_2$, of which one $B_1$ is provided with first and second support bases 4A and 4B having contact tail passing-through apertures 13A and 13B and the other $B_2$ is provided with first and second push bases 8A and 8B having contact tail receiving grooves 9A and 9B. With this arrangement, after the cover parts $B_1$ and $B_2$ have been arranged one upon the other to fix connection wires, the cover parts $B_1$ and $B_2$ are covered on a connector body A such that contact tails 2A and 2B embedded in the connector body A are inserted into the contact tail passing-through apertures 13A and 13B, whereby a piercing connection is established.

In this case, moreover, the connector body A and the cover part $B_1$ of insulating blocks may be previously connected together as a unitary body to form the connector body A in the first embodiment so that this embodiment becomes substantially the same as the first embodiment.

In the above embodiments, the surfaces of the support bases 4A and 4B and push bases 8A and 8B for arranging the connection wires are substantially flat so that there is a risk for the connection wires to fall from the surfaces of the support bases 4A and 4B into the bottoms between the support bases when the connection wires are pushed by the push bases 8A and 8B. Therefore, the proper connection cannot be often accomplished.

Figure 8A:
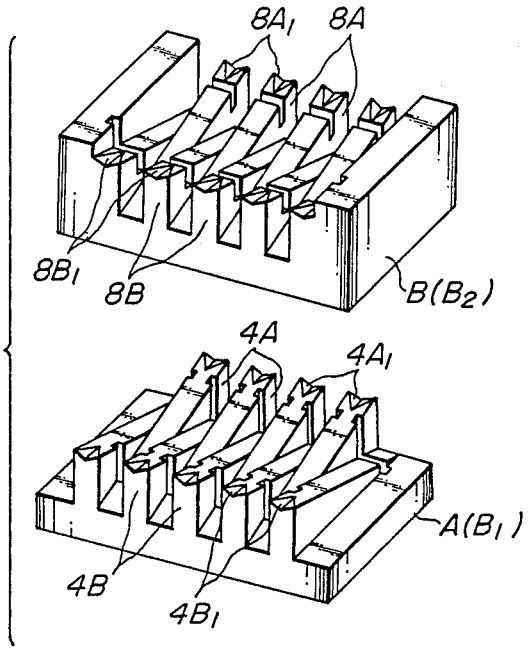
Figure 8B:
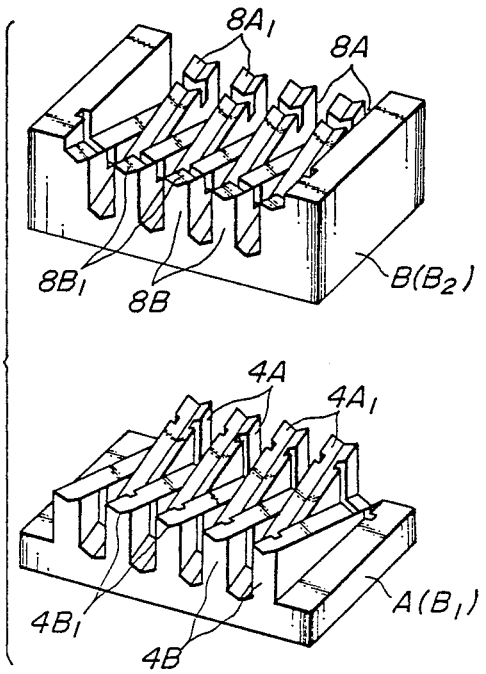

Embodiments shown in FIGS. 8*a* and 8*b* serve to overcome such a problem. In FIG. 8*a*, connection wire positioning recesses $4A_1$, $4B_1$, $8A_1$ and $8B_1$ are provided in the proximities of the uppermost portions of the inclined surfaces of the support bases 4A and 4B and/or the push bases 8A and 8B. In FIG. 8*b*, elongated supporting grooves $4A_1$, $4B_1$, $8A_1$ and $8B_1$ are provided along the inclinations of the support bases 4A and 4B and/or the push bases 8A and 8B.

In the connection wire positioning recesses or the elongated supporting grooves, uppermost ends of the inclination surfaces may be chamfered to prevent wires from being damaged by sharp edges of the uppermost ends of the inclination surfaces.

Figure 9A:
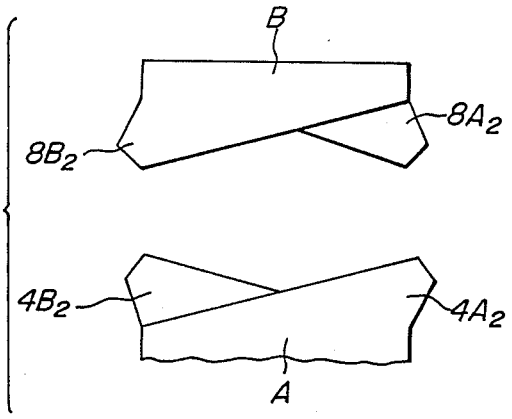
Figure 9B:
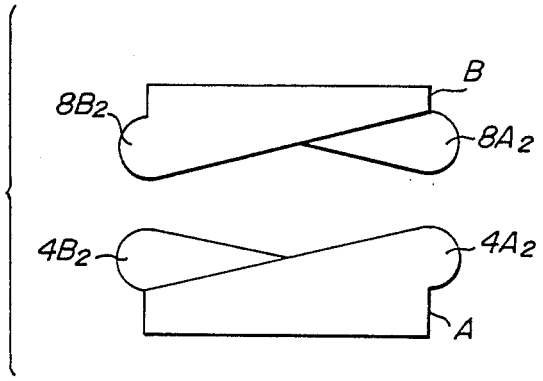

In case of flat cables, moreover, the support bases 4A and 4B and the push bases 8A and 8B are provided at their highest portions with triangular or semicircular piercing assisting projections $4A_2$, $4B_2$ and $8A_2$, $8B_2$ so that torn lengths of the coating 11 of the flat cable 12 are made much longer in order to make easy the piercing by contact tails as shown in FIGS. 9*a* and 9*b*.

Figure 10A:
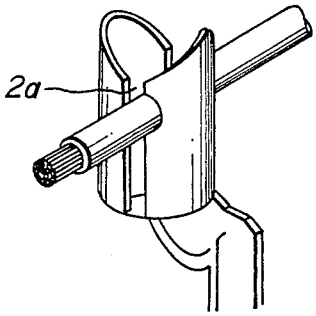
Figure 10B:
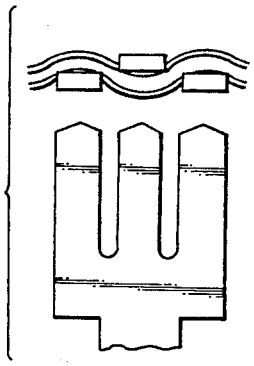
Figure 10C:
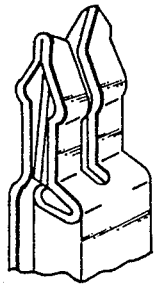

Although the above embodiments have been explained with the contacts having the U-shaped contact tails, the invention is applicable to other conventional contacts, for example, a contact having a tubular tail formed with a pressing slit 2*a* as shown in FIGS. 10*a*, 10*b* and 10*c*.

Figure 11:
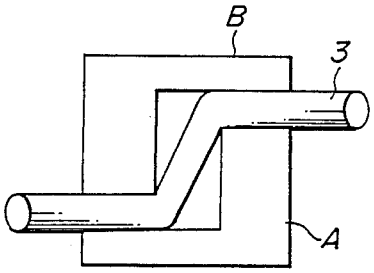
FIG. 11 illustrates a comparative example of the support bases and push bases.

Moreover, the inclination surfaces of the support bases 4A and 4B and push bases 8A and 8B may be like steps as shown in FIG. 11 although they are not preferable. When the inclination surfaces are in the form of steps, connection wires 3 are folded along the steps so that the wires are pulled by folded lengths of the wires. Therefore, there are risks for contact tails to be subjected to tensile forces or deformed or for connection wires to be damaged.

Figure 12:
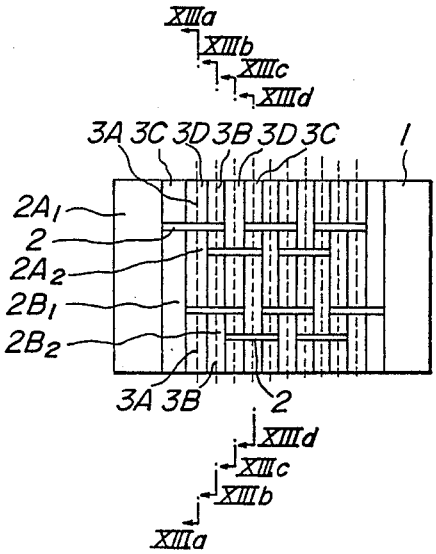
FIGS. 12 and 13*a*, 13*b*, 13*c* and 13*d* are views of a further embodiment of the connector according to the invention.
Figure 13A:
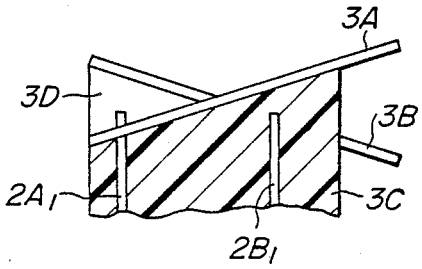
Figure 13C:
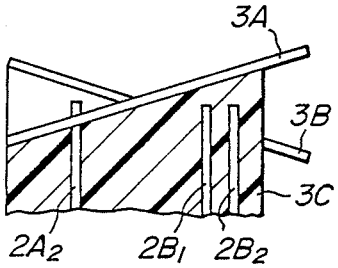
Figure 13B:
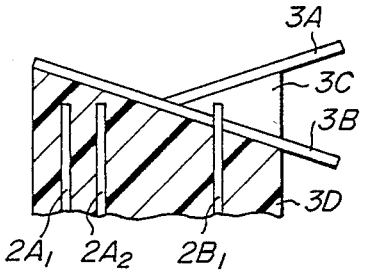
Figure 13D:
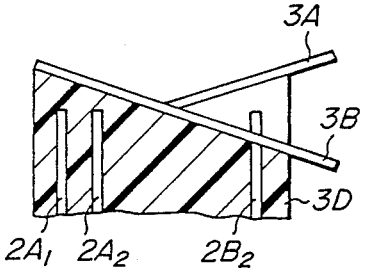

FIG. 12 illustrates a further embodiment. In the above embodiments, contact tails have been explained arranged in two rows. With the embodiment shown in FIG. 12, there are provided contact tails in four rows to form two groups respectively consisting of contact tails $2A_1$ and $2A_2$, and $2B_1$; and $2B_2$, so that the contact tails $2A_1$ are arranged between centers of the contact tails $2A_2$ in one group, and the contact tails $2B_1$ are arranged between centers of the contact tails $2B_2$ in the other group in staggered arrangement, respectively.

As shown in FIGS. 13*a*, 13*b*, 13*c* and 13*d*, alternately inclined support bases 3C and 3D are alternately arranged and the contact tails $2A_1$ and $2A_2$ are so fixed that centers of the contact tails are at the support bases 3D inclined in the same direction and the contact tails $2B_1$ and $2B_2$ are fixed so as to be shifted by a width of one of the support bases relative to the contact tails so that within the width of one contact tail are included the two support bases 3D inclined in the same direction and one support base 3C therebetween.

As shown in FIGS. 13*a*–13*d*, the inclinations and angles thereof of the support bases 3C and 3D are so determined that with respect to one connection wire, one contact tail to be connected to the wire is extended over one support base, but the other contact tails do not extend over the two support bases 3C and 3D.

Figure 14B:
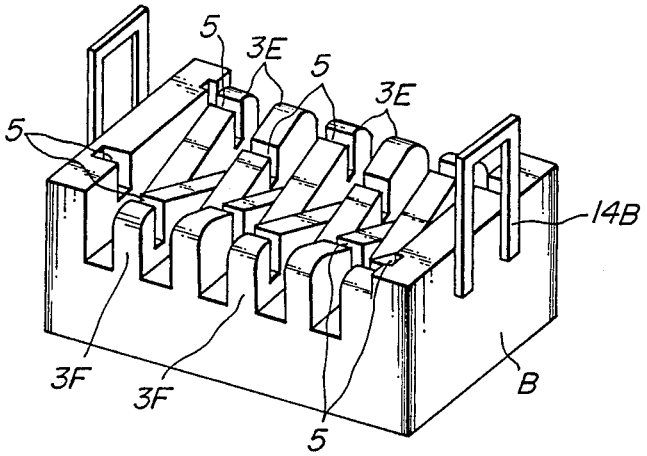
FIGS. 14*a* and 14*b* are perspective views illustrating the connector shown in FIG. 12.
Figure 14A:
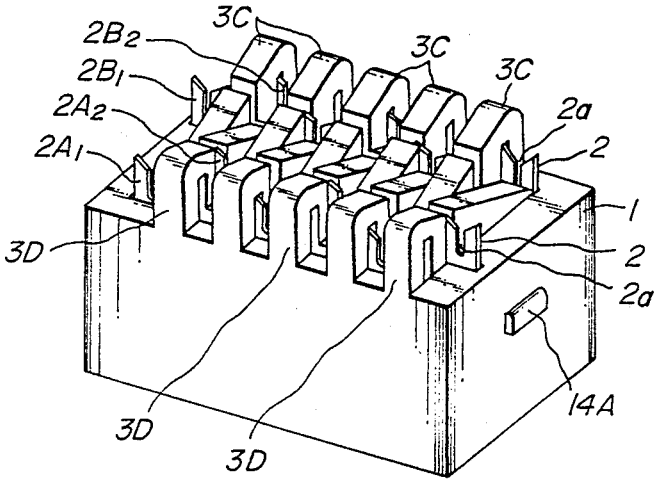

A further modification is illustrated in FIGS. 14*a* and 14*b*, among which FIG. 14*a* is a perspective view of a connector body A and FIG. 14*b* is a perspective view of a cover B thereof.

In FIG. 14*a*, a contact support block 1 comprises locking protrusions 14A, support bases 3C and support bases 3D having inclinations inclined in reverse directions to those of the support bases 3C. Reference numeral 2 denotes contact tails. The tails $2A_1$ and $2A_2$ are fixed in the support block 1 in two rows and staggered such that one tail in one row is located between two adjacent tails in the other row and the tails $2B_1$ and $2B_2$ are also fixed in the support block 1 in two rows and staggered such that one tail in one row is located between two adjacent tails in the other row. Moreover, the tails $2A_1$ and $2A_2$ are shifted by the width of the support base relative to the tails $2B_1$ and $2B_2$. Within a width of one of the contact tails $2A_1$ an $2A_2$ there are two support bases 3C inclined in the same direction and one support base 3D therebetween, while within a width of one of the contact tails $2B_1$ and $2B_2$ there are two support base 3D inclined in the same direction and one support base 3C therebetween. The inclinations and angles thereof of the support bases 3C and 3D are so determined that with respect to one connection wire, one pressing slit 2*a* of one contact tail to be connected to the wire is extended over one support base, but the other contact tails do not extend over two support bases.

In FIG. 14*b*, a cover B has U-shaped locking member 14B and push bases 3E and 3F inclined in directions reverse to those of the support bases 3C and 3D. The push bases 3E and 3F are formed with contact tail receiving grooves 5 for receiving the contact tails. After connection wires 3A and 3B have been arranged on the inclined surfaces of the support bases 3C and 3D of the connector body A, the cover B is covered and connected onto the connector body A by means of the locking protrusions 14A and the U-shaped locking member 14B such that the contact tails enter the contact tail receiving grooves 5. As a result, connection wires 3A and 3B are forced into the contact tail pressing slits 2*a* so as to be connected to the contacts and embraced between the support bases 3C, 3E, 3D and 3F to prevent the connection wires from removing therefrom.

Figure 1A:
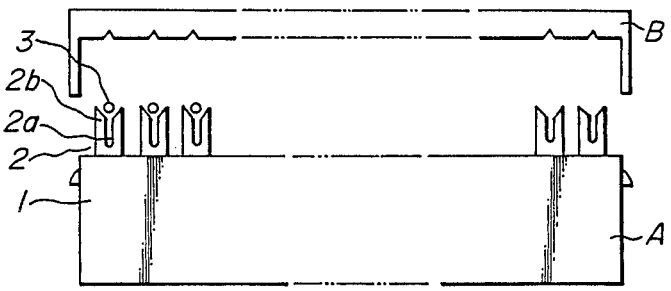
FIG 1a PRIOR ART
FIGS. 1*a* and 1*b* are explanatory views of a connector of the prior art.
Figure 1B:
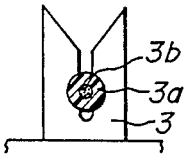
FIG 1b PRIOR ART
Figure 2A:
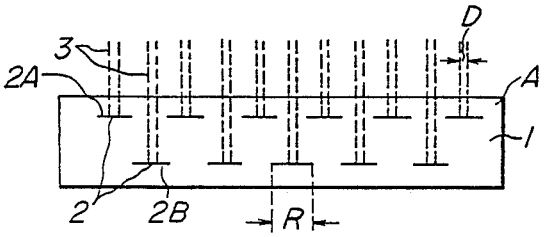
FIG 2a PRIOR ART
FIGS. 2*a* and 2*b* are explanatory views of a connector of the prior art which was intended to be miniaturized.
Figure 2B:
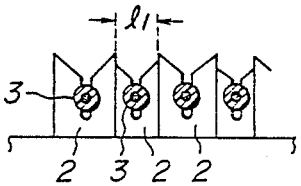
FIG 2b PRIOR ART
Figure 3A:
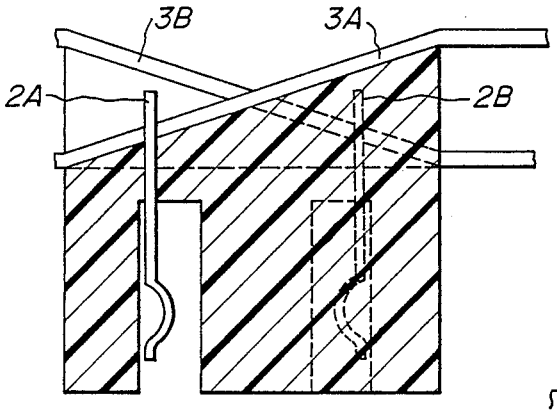
FIGS. 3*a*, 3*b* and 3*c* are views for explaining the connector according to the invention.
Figure 3B:
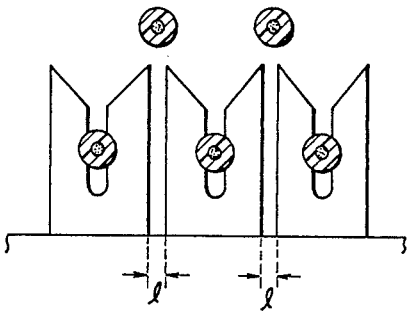
Figure 3C:
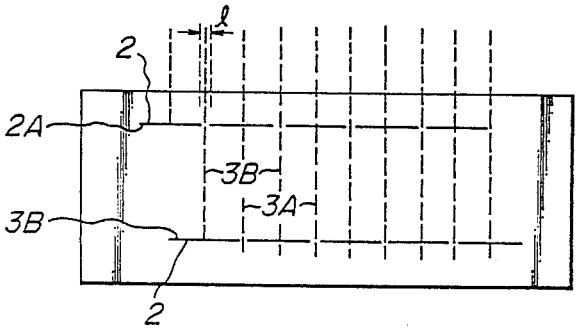

With these arrangements, it is clear in comparison of FIG. 12 with FIGS. 3*b* and 3*c* that the longitudinal length of the connector is considerably reduced in case of the same width of connection wires. With connection wires used at present, the length of the connector is reduced to about one half. Moreover, the embodiment as shown in FIG. 12 is superior to that shown in FIGS. 4*a* and 4*b* without making thin the wall thickness of the support and push bases so that the embodiment shown in FIG. 12 can remove the difficulty in manufacturing such as drop of mold accuracy with the result that the practically useful small type insulation-piercing connector can be provided.

As can be seen from the above explanation, with the insulation-piercing connector having contact tails staggered in two rows capable of leading out connection wires arranged above contact tails arranged in opposition to contact tails to which the wires are connected, so that distances between the adjacent contact tails can be shortened in comparison with those of the prior art. As a result, the miniaturization of the connector can be accomplished which can eliminate the risk of the connection wires to be damaged caused by contacting of the wires with contact tails.

While the invention has been particularly shown and described with reference to preferred embodiments thereof, it will be understood by those skilled in the art that the foregoing and other changes inform and details can be made therein without departing from the spirit and scope of the invention.

What is claimed is:

1. An insulation-piercing connector including a connector body made of an insulating material, a plurality of contacts made of a resilient conductive metal, each consisting of a contact element to be connected to a contact of a mating connector, a fixing element carried by said connector body and a U-shaped piercing terminal element extending from a surface of said connector body and embracing a wire between legs of the U-shaped element, said contacts being arranged staggered in at least two rows, and a cover made of an insulating material and formed with terminal element receiving grooves for receiving the U-shaped elements of said contacts, and when said cover is covered onto said connector body, said cover forcing wires into the U-shaped elements and embracing the wires between the cover and said connector body, wherein surfaces of said connector body for embracing the wires in conjunction with said cover are raising inclination surfaces from a side of the U-shaped piercing elements in one row positioned above the U-shaped piercing elements in the other row to form alternately reversely inclined surfaces, and surfaces of said cover for embracing the wires are inclination surfaces auxiliary with said alternately inclined surfaces of the connector body, said inclined surfaces of said connector body and said cover being provided at their highest portions with piercing assisting projections, thereby elongating torn lengths of coating when a flat cable is used.

2. A connector as set forth in claim 1, wherein said connector body comprises a lower main part having said contacts of which U-shaped piercing elements extend from a surface of the lower main part and an upper part having said alternately inclined surfaces and piercing element passing apertures.

3. A connector as set forth in claim 1, wherein said inclined surfaces of at least one of said connector body and said cover are formed in the proximities of uppermost portions of the inclined surfaces with wire positioning recesses.

4. A connector as set forth in claim 1, wherein said inclined surfaces of at least one of said connector body and said cover are formed therealong with elongated supporting grooves for positioning the wires.

5. A connector as set forth in claim 1, wherein said piercing assisting projections are triangular.

6. A connector as set forth in claim 1, wherein said piercing assisting projections are semicircular.

7. A connector as set forth in claim 1, wherein said contacts are arrange in four rows, in each group of two rows, the contacts are arranged staggered so that within a width of one piercing element are included two inclined surfaces inclined in the same direction and one inclined surface therebetween, and one piercing element of one group is shifted by a width of the inclined surface relative to one piercing element of the other group.

8. An insulation-piercing connector for use with a flat cable having a plurality of wires embedded therein comprising:

a connector body made of an insulating material;

a plurality of contacts made of a resilient conductive metal, each contact consisting of a contact element to be connected to a contact of a mating connector, a fixing element carried by said connector body and a U-shaped piercing terminal element extending from a surface of said connector body and embracing a wire between the legs of the U-shaped element, said contacts being arranged staggered in a least two rows;

a cover made of an insulating material and formed with terminal element receiving grooves for receiving the U-shaped elements of said contacts so that when said cover is positioned on said connector body said cover forces wires into said U-shaped elements and embraces the wires between the cover and the connector body;

said connector body including surfaces for embracing and separating the wires, said surfaces being raised inclination surfaces extending from a side of said U-shaped piercing elements in one row toward and positioned above the U-shaped piercing elements in the other row to form alternately reversely inclined surfaces, said cover including surfaces for embracing the wires which are inclination surfaces complementary with said alternately inclined surfaces of said connector body; and piercing assisting projections positioned on the highest portion of said inclined surfaces of at least one of said connector body and said cover for enabling elongated torn lengths of coating between wires of said flat cable.

* * * * *